US007084813B2

(12) United States Patent
Pathak et al.

(10) Patent No.: US 7,084,813 B2
(45) Date of Patent: Aug. 1, 2006

(54) ANTENNAS WITH REDUCED SPACE AND IMPROVED PERFORMANCE

(75) Inventors: Vaneet Pathak, San Diego, CA (US); Gregory Poilasne, San Diego, CA (US); Laurent Desclos, San Diego, CA (US); Sebastian Rowson, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 118 days.

(21) Appl. No.: 10/322,196

(22) Filed: Dec. 17, 2002

(65) Prior Publication Data

US 2004/0125026 A1 Jul. 1, 2004

(51) Int. Cl.
*H01Q 1/38* (2006.01)

(52) U.S. Cl. ..... 343/700 MS; 343/846

(58) Field of Classification Search ..... 343/700 MS, 343/702, 741, 742, 744, 829, 846
See application file for complete search history.

(56) References Cited

U.S. PATENT DOCUMENTS

| | | | | |
|---|---|---|---|---|
| 3,707,681 | A * | 12/1972 | Grant | 455/275 |
| 3,721,990 | A | 3/1973 | Gibson et al. | 343/726 |
| 3,827,053 | A * | 7/1974 | Willie et al. | 343/701 |
| 4,450,449 | A | 5/1984 | Jewitt | |
| 4,598,276 | A | 7/1986 | Tait | |
| 4,684,952 | A * | 8/1987 | Munson et al. | 343/700 MS |
| 4,749,996 | A | 6/1988 | Tresselt | |
| 5,087,922 | A * | 2/1992 | Tang et al. | 343/814 |
| 5,245,745 | A | 9/1993 | Jensen et al. | |
| 5,309,164 | A | 5/1994 | Dienes et al. | |
| 5,410,323 | A | 4/1995 | Kuroda | |
| 5,450,090 | A | 9/1995 | Gels et al. | 343/700 MS |
| 5,627,550 | A * | 5/1997 | Sanad | 343/700 MS |
| 5,764,190 | A | 6/1998 | Murch et al. | |
| 5,781,158 | A * | 7/1998 | Ko et al. | 343/700 MS |
| 5,835,063 | A | 11/1998 | Brachat et al. | |
| 5,936,583 | A | 8/1999 | Sekine et al. | |
| 5,936,590 | A * | 8/1999 | Funder | 343/795 |
| 5,943,020 | A | 8/1999 | Liebendoerfer et al. | 343/702 |
| 5,966,096 | A | 10/1999 | Brachat | |

(Continued)

FOREIGN PATENT DOCUMENTS

EP 0 604 338 A 6/1994

(Continued)

OTHER PUBLICATIONS

Wheeler, "Small Antennas." IEEE Transactions on Antennas and Propagation, 462-468, Jul. 1975.

(Continued)

*Primary Examiner*—Tho Phan
(74) *Attorney, Agent, or Firm*—Foley & Lardner LLP

(57) ABSTRACT

The disclosed embodiments of antenna elements and antenna element arrangements provide a generally low profile, improved isolation, and providing a larger bandwidth. Certain disclosed antenna elements provide a reduction in the footprint of the antenna elements while maintaining the performance characteristics by providing a greater surface area on either a top, middle or bottom portion of a CLMD antenna. Other disclosed antenna element arrangements provide improved radiation efficiency by providing metallic reflectors on the sides of antenna elements. The isolation characteristics of certain disclosed antenna elements are improved through the use of coplanar wave guides. The bandwidth may be improved through the use of stubs resonators. The bandwidth of the antenna elements may be improved without reducing isolation or shielding by providing a variable gap between two portions of the antenna elements.

25 Claims, 13 Drawing Sheets

U.S. PATENT DOCUMENTS

| | | | | |
|---|---|---|---|---|
| 5,986,606 | A | 11/1999 | Kossiavas et al. | |
| 6,002,367 | A | 12/1999 | Engblom et al. | |
| 6,008,762 | A | 12/1999 | Nghiem | 343/700 MS |
| 6,008,764 | A * | 12/1999 | Ollikainen et al. | 343/700 MS |
| 6,046,707 | A | 4/2000 | Gaughan et al. | |
| 6,114,996 | A * | 9/2000 | Nghiem | 343/700 MS |
| 6,133,880 | A * | 10/2000 | Grangeat et al. | 343/700 MS |
| 6,140,965 | A | 10/2000 | Van Hoozen | |
| 6,140,969 | A | 10/2000 | Lindenmeier et al. | |
| 6,147,649 | A | 11/2000 | Ivrissimtzis et al. | |
| 6,157,348 | A | 12/2000 | Openlander | |
| 6,181,281 | B1 | 1/2001 | Desclos et al. | |
| 6,195,051 | B1 | 2/2001 | McCoy et al. | 343/700 MS |
| 6,211,815 | B1 | 4/2001 | Richey et al. | |
| 6,246,371 | B1 | 6/2001 | Kurz et al. | |
| 6,304,222 | B1 * | 10/2001 | Smith et al. | 343/702 |
| 6,323,810 | B1 * | 11/2001 | Poilasne | 343/700 MS |
| 6,339,409 | B1 | 1/2002 | Warnagiris | |
| 6,348,894 | B1 * | 2/2002 | Lahti | 343/702 |
| 6,362,789 | B1 * | 3/2002 | Trumbull et al. | 343/700 MS |
| 6,366,258 | B1 * | 4/2002 | Reece et al. | 343/816 |
| 6,369,777 | B1 | 4/2002 | Ohara et al. | |
| 6,388,631 | B1 * | 5/2002 | Livingston et al. | 343/767 |
| 6,417,807 | B1 * | 7/2002 | Hsu et al. | 343/700 MS |
| 6,417,817 | B1 * | 7/2002 | Pirila et al. | 343/841 |
| 6,529,749 | B1 * | 3/2003 | Hayes et al. | 455/575.7 |
| 6,639,564 | B1 * | 10/2003 | Johnson | 343/702 |
| 6,759,990 | B1 * | 7/2004 | Rossman | 343/700 MS |

FOREIGN PATENT DOCUMENTS

| | | | |
|---|---|---|---|
| EP | 0 942 488 | A | 9/1999 |
| EP | 1 067 627 | A | 1/2001 |
| JP | 56 012102 | | 2/1981 |
| JP | 09 055621 | A | 2/1997 |
| JP | 2000 031735 | A | 1/2000 |
| JP | 2000 068736 | A | 3/2000 |

OTHER PUBLICATIONS

Sievenpiper et al., "High impedance electromagnetic surfaces with a forbidden frequency band." IEEE Transactions on Microwave Theory and Techniques, 47(11): 2059-2074, 1999.

International Search Report from PCT Application No. PCT/US02/20242.

* cited by examiner

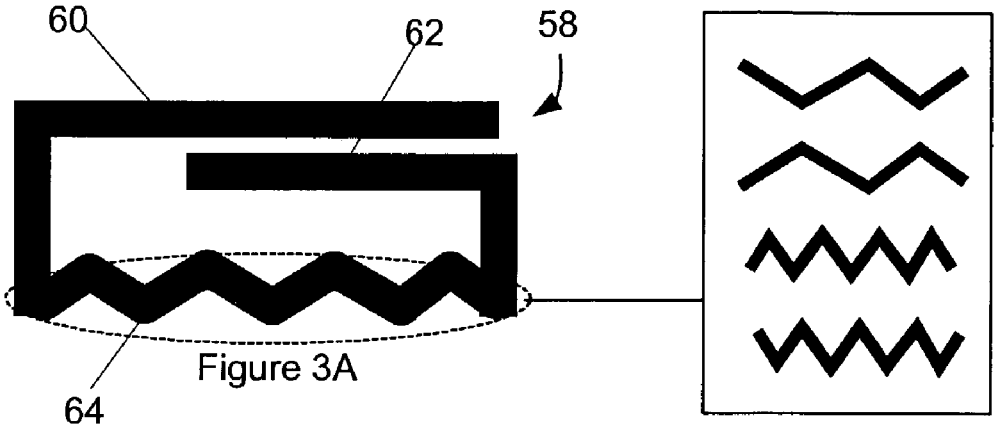
Figure 3A
Figure 3B
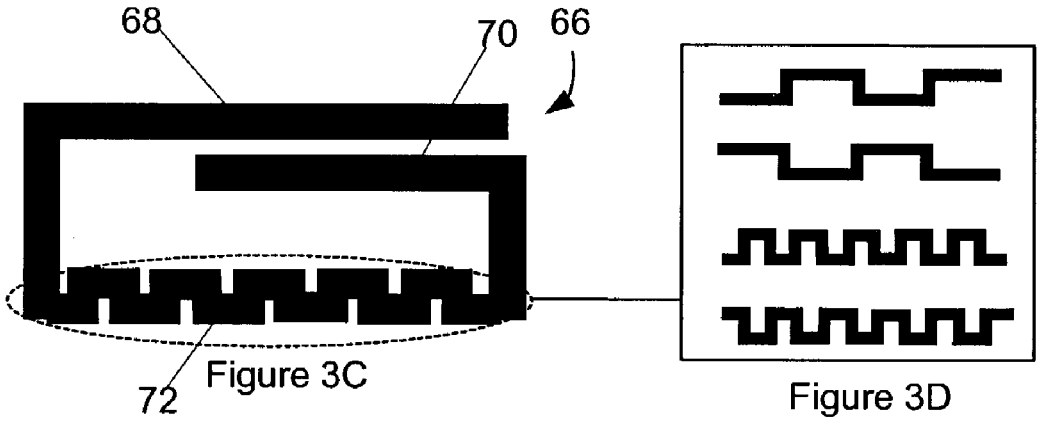
Figure 3C
Figure 3D
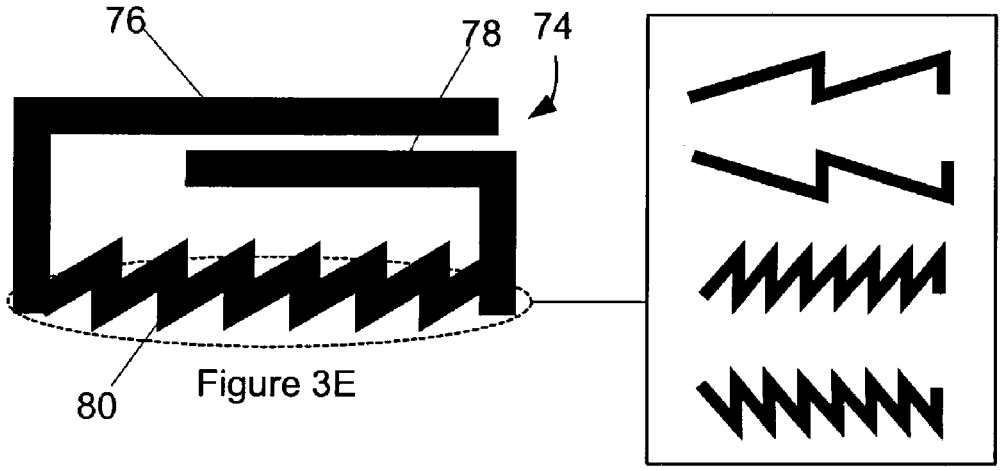
Figure 3E
Figure 3F

ANTENNAS WITH REDUCED SPACE AND IMPROVED PERFORMANCE

CROSS-REFERENCE TO RELATED APPLICATIONS

This application relates to co-pending application Ser. No. 09/892,928, filed on Jun. 26, 2001, entitled "Multi Frequency Antenna Structure and Methods Reusing the Volume of an Antenna" by L. Desclos et al., owned by the assignee of this application and incorporated herein by reference.

This application relates to co-pending application Ser. No. 10/076,922, filed on Feb. 8, 2002, entitled "Multi Frequency Antenna Structures with a New E-Field Distribution for Very Low-Profile Antenna Applications" by G. Poilasne et al., owned by the assignee of this application and incorporated herein by reference.

This application relates to co-pending application Ser. No. 10/133,717, filed on Apr. 25, 2002, entitled "Low-Profile, Multi-Frequency, Multi-Band, Capacitively Loaded Magnetic Dipoles" by G. Poilasne et al., owned by the assignee of this application and incorporated herein by reference.

FIELD OF THE INVENTION

The present invention relates generally to the field of wireless communications, and particularly to the size reduction and performance improvement of capacitively loaded magnetic dipole antennas.

BACKGROUND

The information contained in this section relates to the background of the art of the present invention without any admission as to whether or not it legally constitutes prior art.

Thin, capacitively loaded magnetic dipoles offer excellent efficiency and isolation with a relatively small volume. However, various applications require even greater efficiency and isolation, even smaller profiles, and larger bandwidths.

The present invention addresses the requirements of certain wireless communications applications by providing low-profile antennas that may provide a larger bandwidth and improved efficiency and isolation.

SUMMARY OF THE INVENTION

The disclosed embodiments of the present invention include antenna elements and antenna element arrangements having a generally low profile, improved isolation, and providing a larger bandwidth. The disclosed embodiments include antenna elements having improved grounding characteristics to improve isolation. Other disclosed embodiments provide a reduction in the footprint of the antenna elements while maintaining the performance characteristics by providing a greater surface area on either a top, middle or bottom portion of a CLMD antenna.

Further embodiments provide antenna element arrangements with improved radiation efficiency by providing metallic reflectors on the sides of antenna elements. In still other embodiments, the isolation characteristics of antenna elements are improved through the use of coplanar wave guides. The bandwidth may be improved through the use of stubs resonators. In yet further embodiments, the bandwidth of the antenna elements is improved without reducing isolation or shielding by providing a variable gap between two portions of the antenna elements.

In other embodiments, shielding of the antenna element is improved by providing a shield between at least a portion of the antenna element and a ground plane. In additional embodiments, a lower profile is achieved by positioning the antenna elements in a coplanar manner with a ground plane. In further embodiments, the isolation of the antenna element is improved by positioning the antenna element in a cutout provided in the ground plane. In still further embodiments, the antenna element arrangement may achieve a larger bandwidth by positioning two or more antenna elements in a plurality of cutouts in the ground plane. Further, a savings in volume may be achieved by positioning other components within the footprint of the antenna element.

This summary does not purport to define the invention. The invention is defined by the claims.

BRIEF DESCRIPTION OF THE DRAWINGS

FIG. 3A illustrates a side-view of another embodiment of an antenna element in accordance with the present invention;

FIG. 3B illustrates a side-view of various embodiments of the bottom portion of the antenna element illustrated in FIG. 3A;

FIG. 3C illustrates a side-view of another embodiment of an antenna element in accordance with the present invention;

FIG. 3D illustrates a side-view of various embodiments of the bottom portion of the antenna element illustrated in FIG. 3C;

FIG. 3E illustrates a side-view of another embodiment of an antenna element in accordance with the present invention;

FIG. 3F illustrates a side-view of various embodiments of the bottom portion of the antenna element illustrated in FIG. 3E;

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1A:
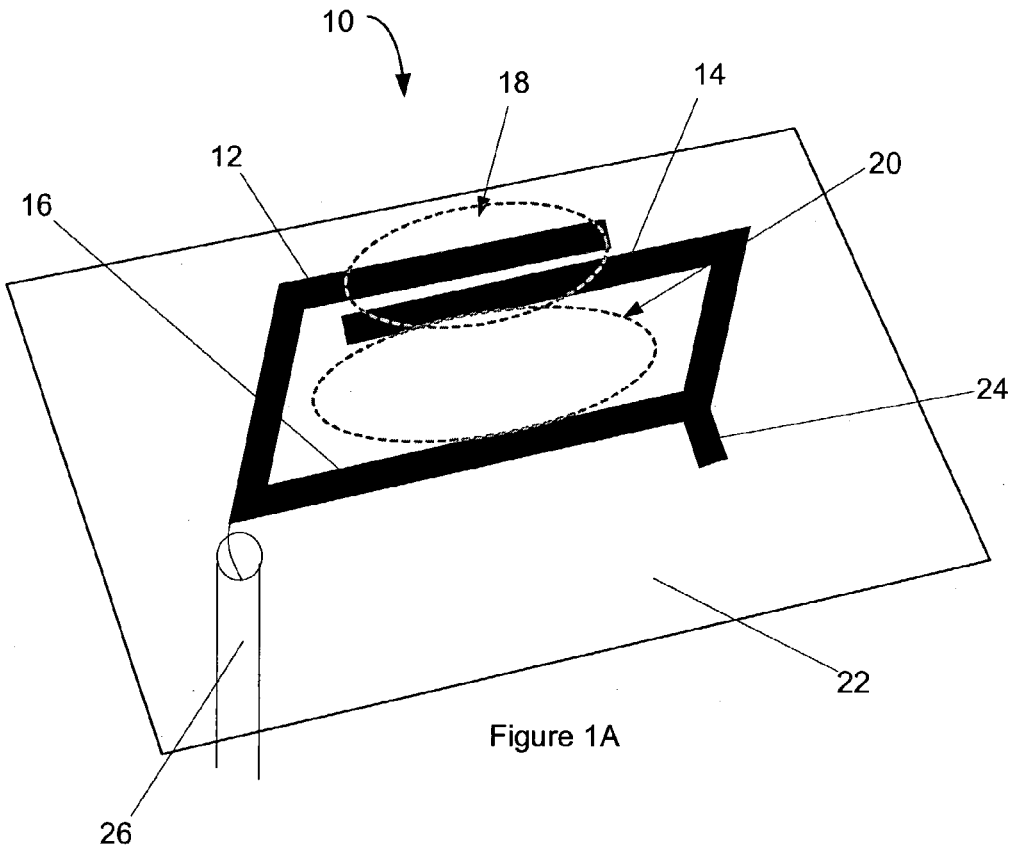
FIG. 1A illustrates a three-dimensional view of an embodiment of an antenna element.
Figure 1B:
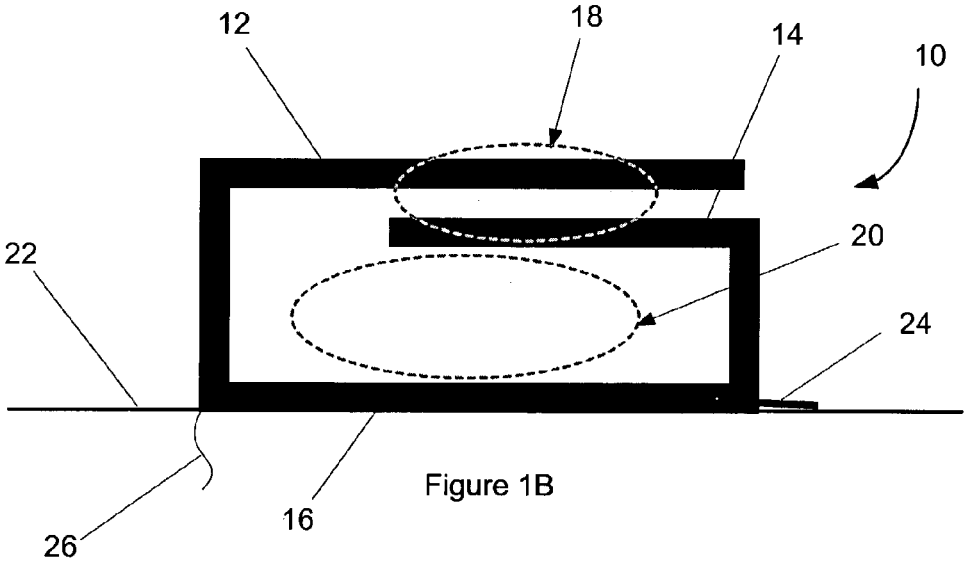
FIG. 1B illustrates a side-view of the antenna element illustrated in FIG. 1A.

FIGS. 1A and 1B illustrate an embodiment of a capacitively loaded magnetic dipole (CLMD) antenna. The antenna element 10 includes a top portion 12, a middle portion 14 and a bottom portion 16. Each portion 12, 14, 16 may be a two-dimensional plate or a one-dimensional element. The top portion 12 and the middle portion 14 form a capacitive component 18 of the antenna element 10. A loop between the middle portion 14 and the bottom portion 16 forms an inductive component 20 of the antenna element 10. The antenna element 10 is connected to a grounding plane 22 by a grounding point 24. A feeding line 26 provides power to the antenna element 10.

Figure 2A:
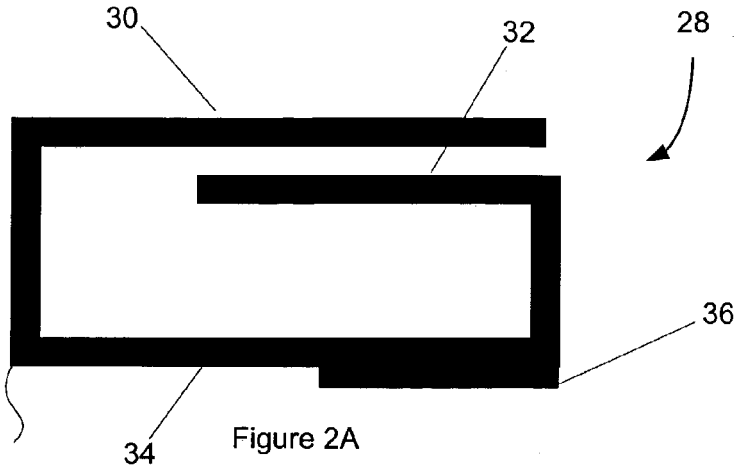
FIG. 2A illustrates a side-view of an embodiment of antenna element in accordance with the present invention.

FIG. 2A illustrates a side-view of an antenna element 28 similar to the antenna element 10 described above with reference to FIGS. 1A and 1B. The antenna element 28 includes a top portion 30, middle portion 32 and bottom portion 34 forming a capacitive component and an inductive component. The embodiment illustrated in FIG. 2A provides improved grounding of the antenna element 10 to a grounding plane (not shown in FIG. 2A) through an elongated grounding point 36. The elongated grounding point 36 illustrated in FIG. 2A extends from one end of the bottom portion 34 inward by a predetermined length. The size of the grounding point 36 may be selected for the desired grounding characteristics of the antenna element 28. Thus, the embodiment illustrated in FIG. 2A provides a larger surface area for the grounding of the antenna element 28.

Figure 2B:
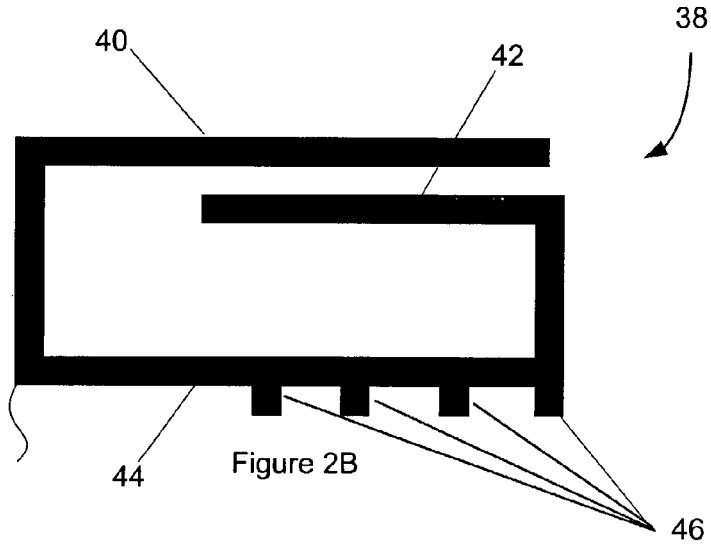
FIG. 2B illustrates a side-view of another embodiment of antenna element in accordance with the present invention.

FIG. 2B illustrates another embodiment of an antenna element with improved grounding characteristics. In this embodiment, an antenna element 38 has a top portion 40, a middle portion 42 and a bottom portion 44. The antenna element 38 is provided with a plurality of grounding points 46 extending downward from the bottom portion 44 for improved grounding of the antenna element 38. In the embodiment illustrated in FIG. 2B, four grounding points 46 are provided. The four grounding points 46 are positioned in an equally spaced apart configuration on one side of the bottom portion 44.

Figure 2C:
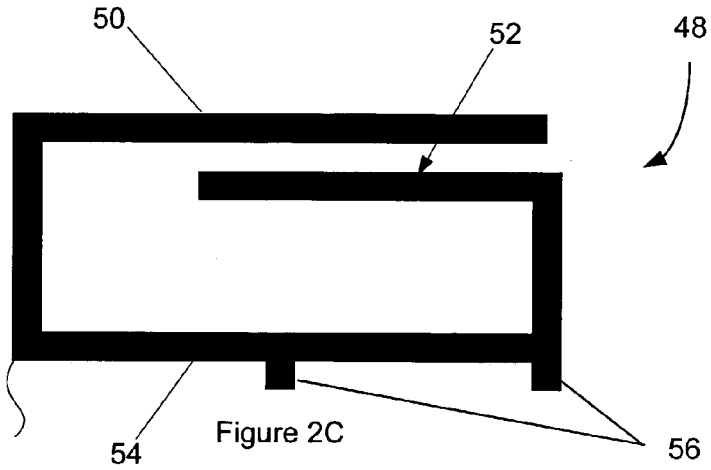
FIG. 2C illustrates a side-view of yet another embodiment of antenna element in accordance with the present invention.

FIG. 2C illustrates yet another embodiment of an antenna element with improved grounding characteristics. In this embodiment, an antenna element 48 has a top portion 50, a middle portion 52 and a bottom portion 54. The antenna element 48 is provided with a pair of grounding points 56 extending downward from the bottom portion 44. The two grounding points 46 are positioned at one end and the middle of the bottom portion 44 for improved grounding of the antenna element 48.

FIG. 3A illustrates a side-view of a CLMD antenna element adapted to provide improved performance while maintaining a relatively small package size or footprint. The illustrated antenna element 58 includes a top portion 60, a middle portion 62 and a bottom portion 64. While the top portion 60 and the middle portion 62 are similar to those illustrated in the above-described embodiments, the embodiment illustrated in FIG. 3A includes a bottom portion 64 having a V-shaped ridge pattern. The ridged pattern of the bottom portion 64 effectively provides a greater surface area for the bottom portion 64 without increasing the footprint of the antenna element 58. In certain embodiments, the bottom of one or more ridge may serve as a grounding point. In other embodiments, as illustrated in FIG. 3A, a separate grounding point may be provided. Thus, improved performance is achieved without increasing the size of the antenna element.

FIG. 3B illustrates a variety of ridged patterns which may be applied to the bottom portion 64 of the antenna element 58 illustrated in FIG. 3A. As illustrated in FIG. 3B, the size and shape of the ridges may be varied to achieve desired performance characteristics of the antenna element.

FIG. 3C illustrates another embodiment of an CLMD antenna element with improved performance without increasing or modifying the footprint. The antenna element 66 illustrated in FIG. 3C includes a top portion 68 and a middle portion 70 similar to those described above. The antenna element 66 includes a bottom portion 72 having block ridges formed thereon. As illustrated in FIG. 3D, the block ridges may be formed of a variety of shapes and sizes to provide the desired performance characteristics for the antenna element 66.

FIG. 3E illustrates yet another embodiment of an CLMD antenna element with improved performance without improved footprint. The antenna element 74 illustrated in FIG. 3E includes a top portion 76 and a middle portion 78 similar to those described above. The antenna element 74 includes a bottom portion 80 having saw-tooth ridges formed thereon. As illustrated in FIG. 3F, the saw-tooth ridges may be formed of a variety of shapes and sizes to provide the desired performance characteristics for the antenna element 66.

Figure 4A:
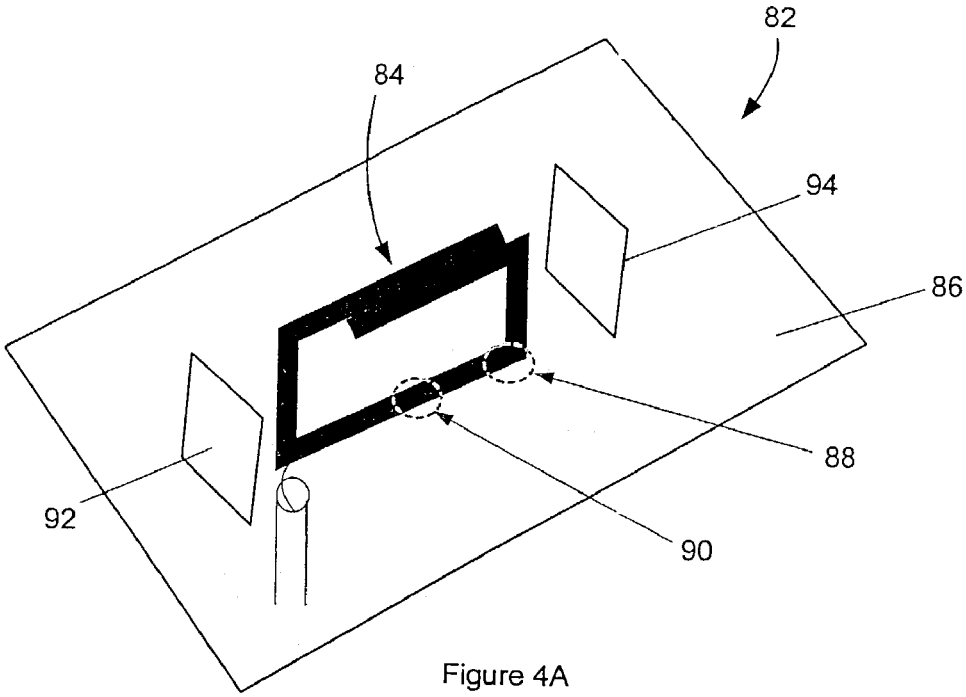
FIG. 4A illustrates a three-dimensional view of an embodiment of an antenna element arrangement in accordance with the present invention.
Figure 4B:
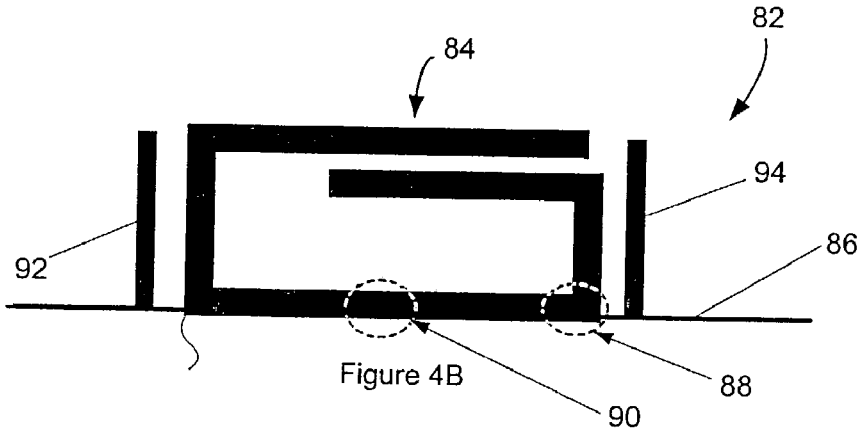
FIG. 4B illustrates a side-view of the antenna element arrangement illustrated in FIG. 4A.
Figure 4C:
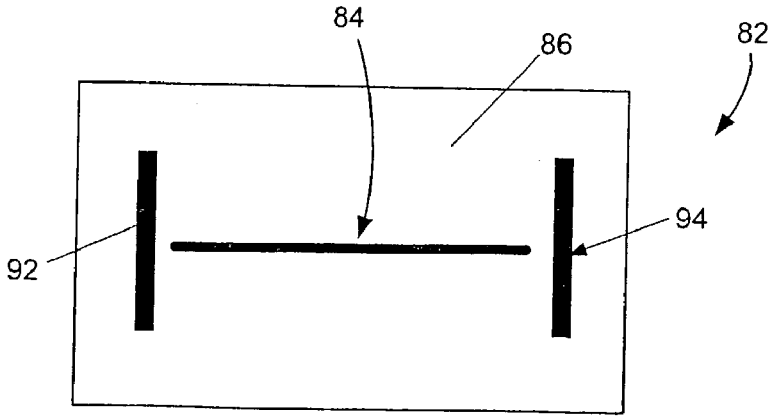
FIG. 4C illustrates a top-view of the antenna element arrangement illustrated in FIGS. 4A and 4B.

FIG. 4A-4C illustrate an antenna element arrangement for providing a different field distribution and increased grounding of the antenna element. The antenna element arrangement 82 includes an antenna element 84 grounded on a grounding plane 86 by a pair of grounding points 88, 90. The antenna element 84 is positioned substantially perpendicular to the plane of the grounding plane 86. A metallic reflector 92, 94 is provided on each side of the antenna element 84. The reflectors 92, 94 are positioned substantially perpendicular to the plane of the grounding plane 86 and substantially perpendicular to the plane of the antenna element 84. Thus, the metallic reflectors 92, 94 serve to improve the radiation efficiency of the antenna element 84 by altering the field distribution.

Figure 5A:
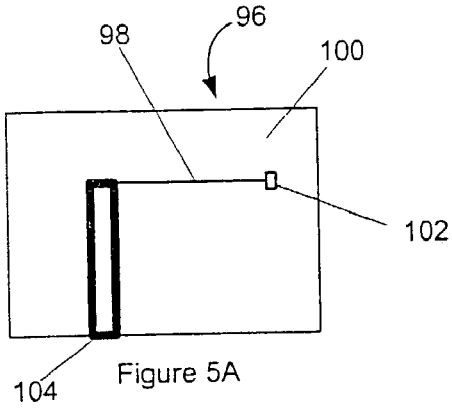
FIG. 5A illustrates a top-view of an embodiment of an antenna element arrangement in accordance with the present invention.
Figure 5B:
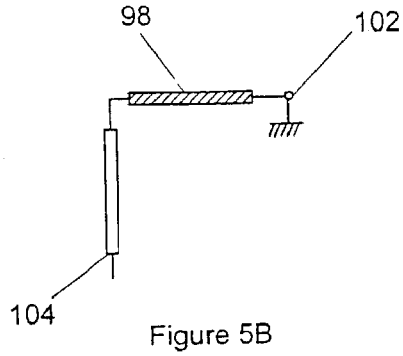
FIG. 5B illustrates a radio frequency (RF) schematic of the antenna element arrangement of FIG. 5A.

FIG. 5A illustrates an embodiment of an antenna element arrangement in accordance with the present invention. The antenna element arrangement 96 includes an antenna element 98 positioned atop a ground plane 100 and grounded through a ground pad 102. A coplanar wave guide (CPWG) 104 is provided on the board of the communication system to feed the antenna element 98. CPWG's are well known to those skilled in the art. The CPWG 104 provides the antenna element 98 with improved isolation characteristics. FIG. 5B illustrates a radio frequency (RF) schematic corresponding to the embodiment illustrated in FIG. 5A. As noted above, the CPWG 104 is in communication with the antenna element 98.

Figure 5C:
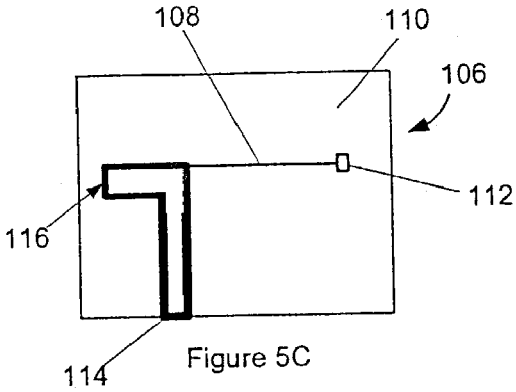
FIG. 5C illustrates a top-view of another embodiment of an antenna element arrangement in accordance with the present invention.
Figure 5D:
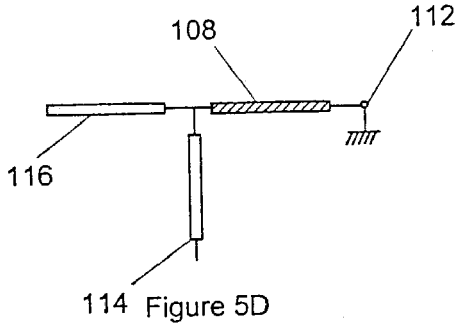
FIG. 5D illustrates a radio frequency (RF) schematic of the antenna element arrangement of FIG. 5C.

FIG. 5C illustrates another embodiment of an antenna element arrangement in accordance with the present invention. The arrangement 106 includes an antenna element 108 positioned atop a ground plane 110 and grounded through a ground pad 112. A CPWG 114 is provided in communication with the antenna element 108. Further, the arrangement 106 includes a single-stub resonator 116. The position, line, and width of the stub 116 on the line (CPWG) are dependent upon the input impedance of the antenna. Stubs are well known to those skilled in the art and can be either open-circuited or short-circuited. The arrangement 106 may include any number of stubs 116. The number of studs may be selected depending on the bandwidth requirements of the antenna element 108. Stubs are low-Q systems, collecting energy at the frequency near that of the antenna. This energy is then leaked from the stub and radiated by the antenna, thus improving the bandwidth of the antenna. FIG. 5D illustrates an RF schematic of the embodiment illustrated in FIG. 5C.

Figure 5E:
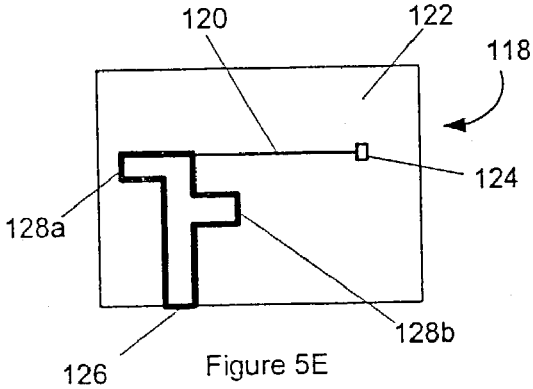
FIG. 5E illustrates a top-view of another embodiment of an antenna element arrangement in accordance with the present invention.
Figure 5F:
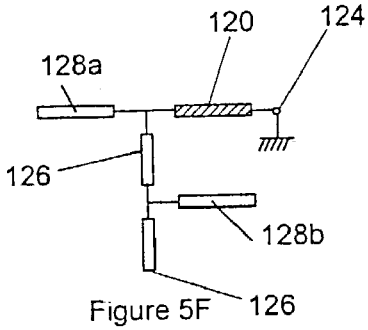
FIG. 5F illustrates an embodiment of a radio frequency (RF) schematic of the antenna element arrangement of FIG. 5E.
Figure 5G:
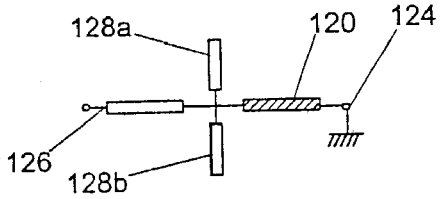
FIG. 5G illustrates another embodiment of a radio frequency (RF) schematic of the antenna element arrangement of FIG. 5E.
Figure 5H:
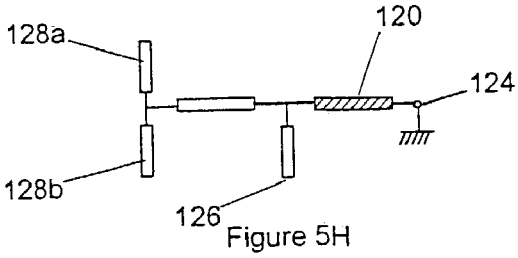
FIG. 5H illustrates yet another embodiment of a radio frequency (RF) schematic of the antenna element arrangement of FIG. 5E.

FIG. 5E illustrates yet another embodiment of an antenna element arrangement in accordance with the present invention. The arrangement 118 includes an antenna element 120 positioned atop a ground plane 122 and grounded through a ground pad 124. A CPWG 126 is provided in communication with the antenna element 120. Further, the arrangement 118 includes two stubs 128*a*, 128*b*. The two stubs 128*a*, 128*b* create two different resonant frequencies, which may be used to improve the bandwidth of the antenna element 120. Again, the position, line, and width of the stub on the line (CPW) are dependent upon the input impedance of the antenna. FIGS. 5F–5H illustrate various embodiments of radio frequency (RF) schematics of the antenna element arrangement described above with reference to FIG. 5E.

Figure 6A:
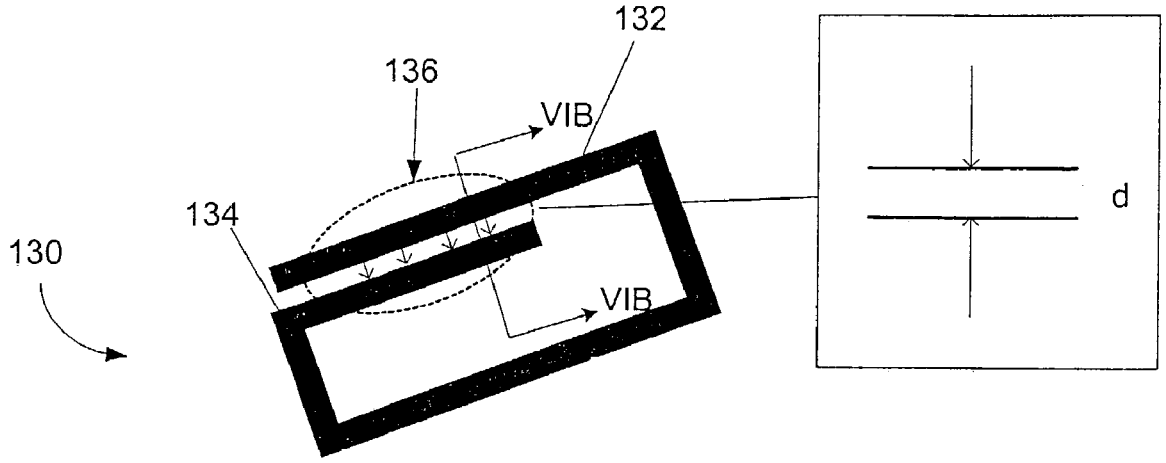
FIG. 6A illustrates a side-view of an embodiment of an antenna element.

FIG. 6A illustrates an antenna element similar to that described above with reference to FIGS. 1A and 1B. The antenna element 130 includes a top portion 132 and a middle portion 134 that are separated by a gap of size d. An electric field 136 is formed in the gap between the top portion 132 and the middle portion 134 when the antenna element is charged. The size of the gap, d, affects the confinement of the electric field 136 and, thus, the isolation and bandwidth of the antenna element 130. A smaller gap size, d, results in a more confined electric field, providing increased isolation and shielding for the antenna element 130. Conversely, a larger gap size, d, results in a less confined electric field 136, providing reduced isolation and shielding, but a larger bandwidth.

Figure 6B:
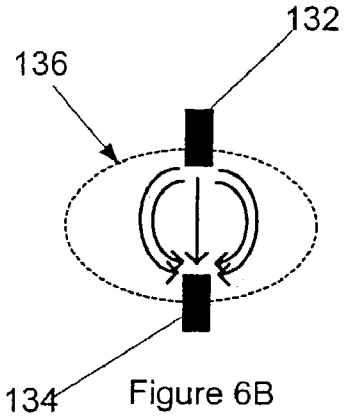
FIGS. 6B and 6C illustrate cross-sectional views taken along VIB—VIB of the antenna element illustrated in FIG. 6A.
Figure 6C:
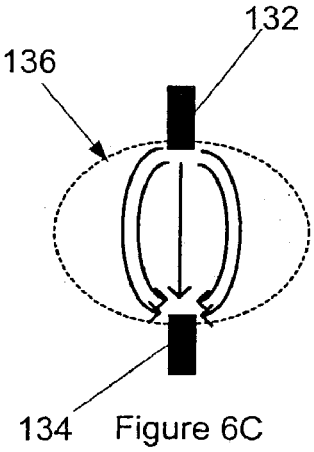

FIGS. 6B and 6C are cross-sectional views along VIB—VIB of FIG. 6A and illustrate the shape of the electric field 136 with variations is the size of the gap. FIG. 6B illustrates an electric field for a relatively small gap size, while FIG. 6C illustrates the electric field for a relatively large gap size.

Figure 6D:
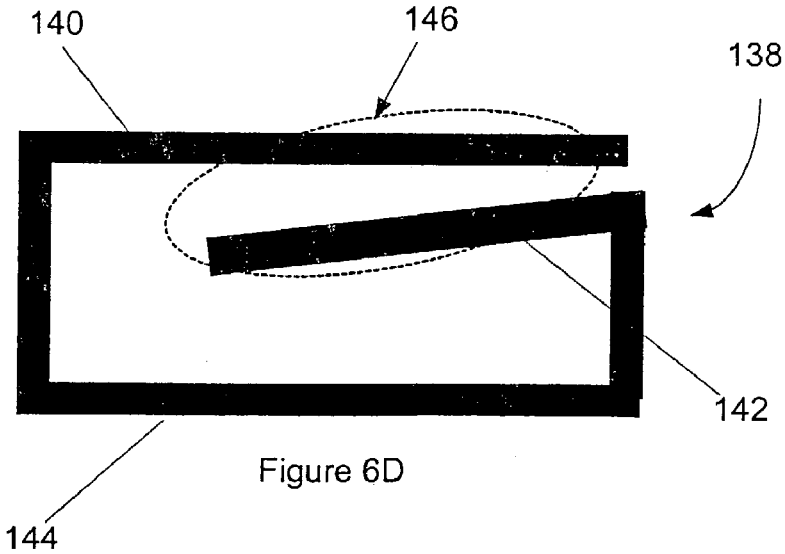
FIG. 6D illustrates a side-view of an embodiment of an antenna element in accordance with the present invention.

FIG. 6D illustrates an embodiment of an antenna element adapted to provide greater bandwidth without reducing shielding. The illustrated antenna element 138 includes a top portion 140, a middle portion 142 and a bottom portion 144. In this embodiment, the middle portion 142 is angled downward as it protrudes inward. This angled configuration results in a tapered gap 146 between the top portion 140 and the middle portion 142. The tapered gap 146 provides the antenna element 138 with greater bandwidth capability without sacrificing shielding.

Figure 7A:
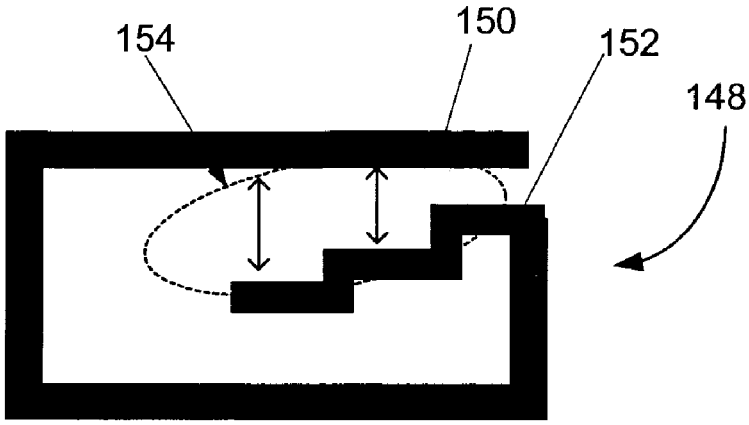
FIG. 7A illustrates a side-view of another embodiment of an antenna element in accordance with the present invention.
Figure 7B:
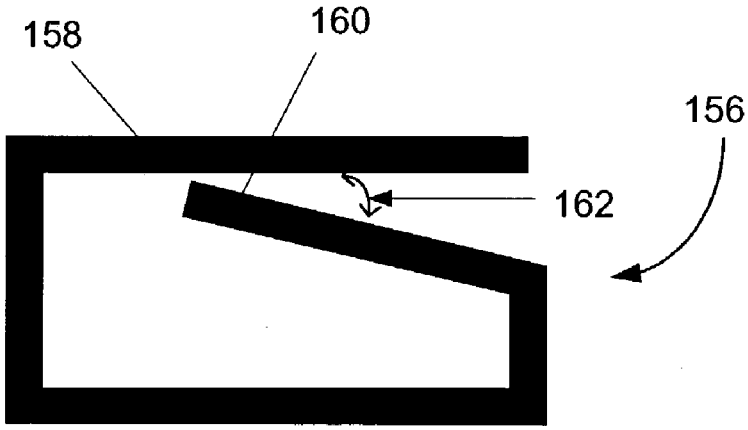
FIG. 7B illustrates a side-view of still another embodiment of an antenna element in accordance with the present invention.
Figure 7C:
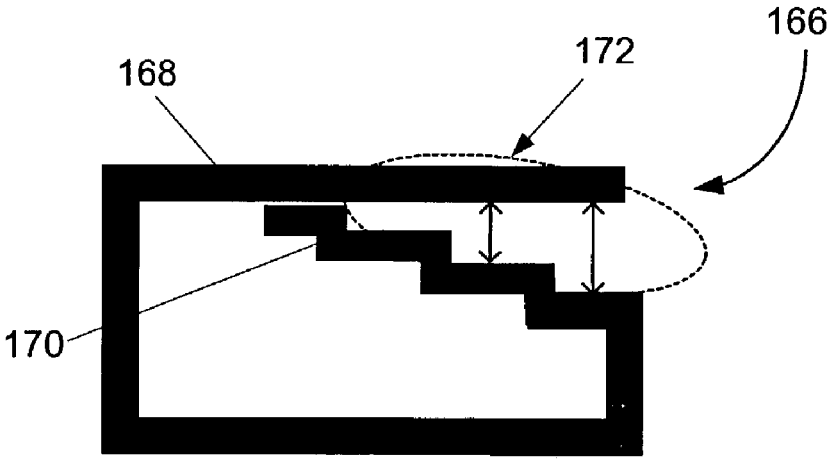
FIG. 7C illustrates a side-view of yet another embodiment of an antenna element in accordance with the present invention.

FIGS. 7A–7C illustrate additional embodiments of antenna elements having variable gaps between the top portions and the middle portions. FIG. 7A illustrates an antenna element 148 having a top portion 150 and a middle portion 152. The middle portion 152 is provided with a downwardly stepped configuration to provide a gap 154 with a variable size between the top portion 150 and the middle portion 152. Although the embodiment illustrated in FIG. 7A is provided with a middle portion 152 having three steps, other embodiments may have any practical number of steps.

FIG. 7B illustrates an antenna element 156 having a top portion 158 and a middle portion 160. The middle portion 160 is upwardly angled to provide a tapered gap 162 with a variable size between the top portion 158 and the middle portion 160.

FIG. 7C illustrates an antenna element 166 having a top portion 168 and a middle portion 170. The middle portion 170 is provided with a upwardly stepped configuration to provide a gap 172 with a variable size between the top portion 168 and the middle portion 170.

FIGS. 8A–8D illustrate further embodiments of antenna elements in accordance with the present invention. The illustrated embodiments provide antenna elements with reduced sizes (or footprints) without a decrease in performance.

Figure 8A:
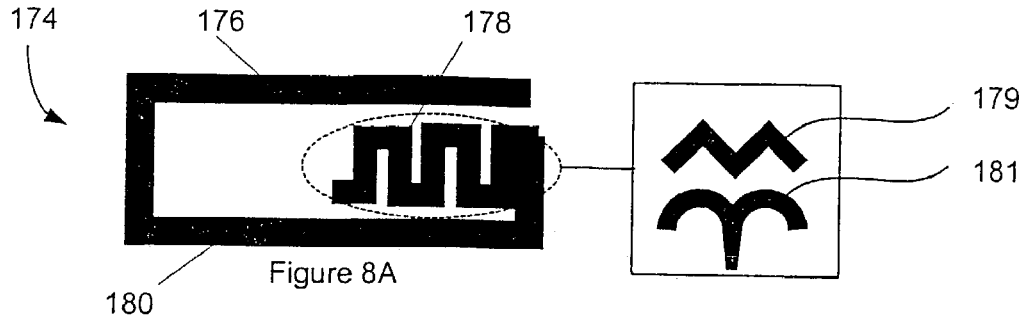
FIG. 8A illustrates a side-view of an embodiment of an antenna element in accordance with the present invention.

FIG. 8A illustrates an antenna element 174 with a top portion 176, a middle portion 178 and a bottom portion 180. In this embodiment, a larger surface area for the middle portion 178 is achieved through a ridged configuration. In the illustrated embodiment, the middle portion 178 is provided with a plurality of block ridges to maintain the electric field strength between the top portion 176 and the middle portion 178 while reducing the footprint of the antenna element 174. Other embodiments may include slanted ridges 179 or rounded ridges 181, as illustrated in FIG. 8A.

Figure 8B:
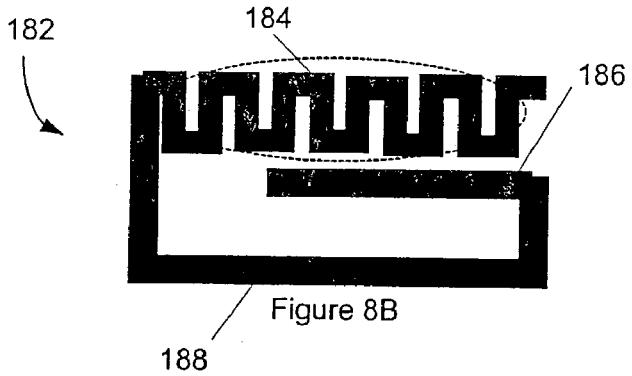
FIG. 8B illustrates a side-view of another embodiment of an antenna element in accordance with the present invention.

FIG. 8B illustrates an antenna element 182 with a top portion 184, a middle portion 186 and a bottom portion 188. In this embodiment, a larger surface area for the top portion 184 is achieved through a ridged configuration. In the illustrated embodiment, the top portion 184 is provided with a plurality of block ridges to maintain the electric field strength between the top portion 184 and the middle portion 186 while reducing the footprint of the antenna element 182.

Figure 8C:
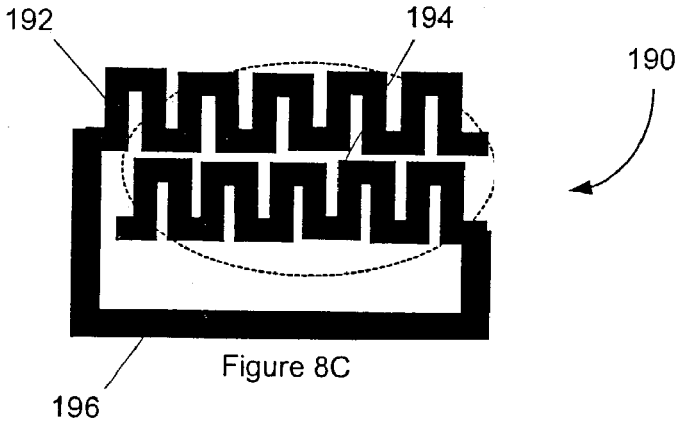
FIG. 8C illustrates a side-view of yet another embodiment of an antenna element in accordance with the present invention.

FIG. 8C illustrates an antenna element 190 with a top portion 192, a middle portion 194 and a bottom portion 196. In this embodiment, both the top portion 192 and the middle portion 194 are provided with a ridged configuration, resulting a larger surface area for each. As with the embodiments described above with reference to FIGS. 8A and 8B, the ridged configurations allow the antenna element 190 to maintain the electric field strength between the top portion 192 and the middle portion 194 while reducing the footprint of the antenna element 182. Configuring both the top portion 192 and the middle portion 194 with ridges allows for an increased reduction in the footprint.

Figure 8D:
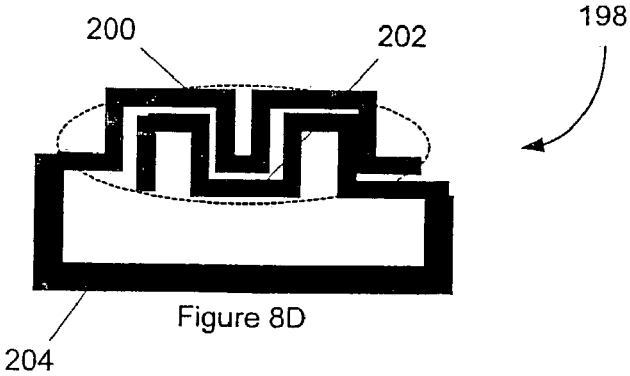
FIG. 8D illustrates a side-view of still another embodiment of an antenna element in accordance with the present invention.

FIG. 8D illustrates an antenna element 198 with a top portion 200, a middle portion 202 and a bottom portion 204. In this embodiment, both the top portion 192 and the middle portion 194 are provided with parallel ridges. Thus, the top portion 200 and the middle portion 202 track each other, maintaining a constant gap size between them. As with the embodiments described above with reference to FIGS. 8A–8C, the ridged configurations allow the antenna element 198 to maintain the electric field strength between the top portion 200 and the middle portion 202 while reducing the footprint of the antenna element 198.

The features of the embodiments of the antenna elements described above with reference to FIGS. 6A–8D effectively change the inductance or the capacitance of the CLMD antenna element. It will be understood by those skilled in the art that the various features may be combined to change both the inductance and capacitance in order to achieve desired antenna element characteristics.

FIGS. 9A–9D illustrate further embodiments of antenna elements in accordance with the present invention. The illustrated embodiments provide improved isolation by at least partially shielding the bottom plate of the antenna elements from a grounding plane and modifying the inductance component of the antenna elements.

Figure 9A:
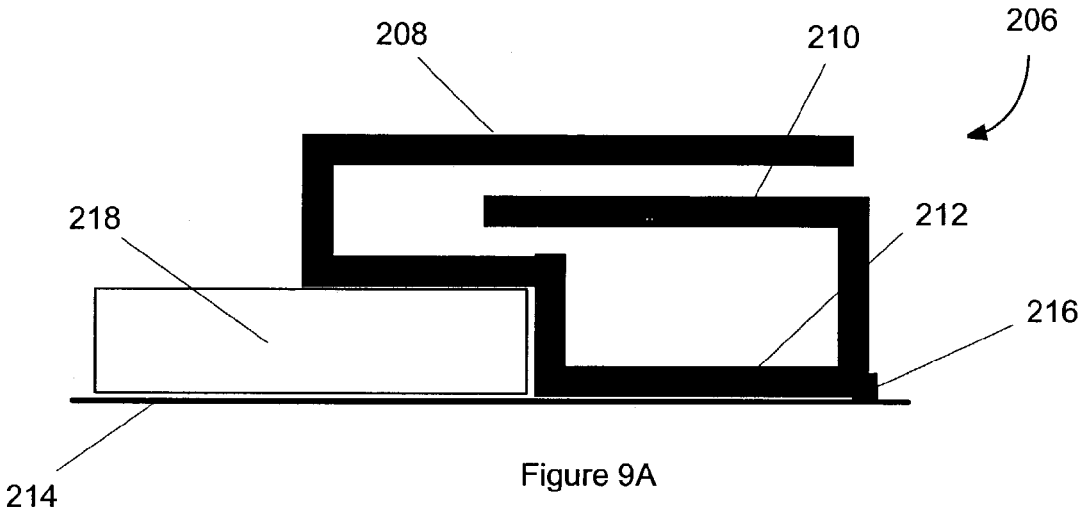
FIG. 9A illustrates a side-view of an embodiment of an antenna element arrangement in accordance with the present invention.

FIG. 9A illustrates an antenna element 206 with a top portion 208, a middle portion 210 and a bottom portion 212. The antenna element 206 is positioned atop a ground plane 214 and is grounded through a ground pad 216. The bottom portion 212 of the antenna element 206 is contoured to accommodate a shield 218 between the ground plane 214 and a portion of the bottom portion 212. In the illustrated embodiment, the bottom portion 212 is provided with a raised left side, allowing the shield 218 to be positioned from approximately the middle of the bottom portion 212 and extended leftward. The positioning of the shield 218 improves the isolation of the antenna element 206, thereby improving performance.

Figure 9B:
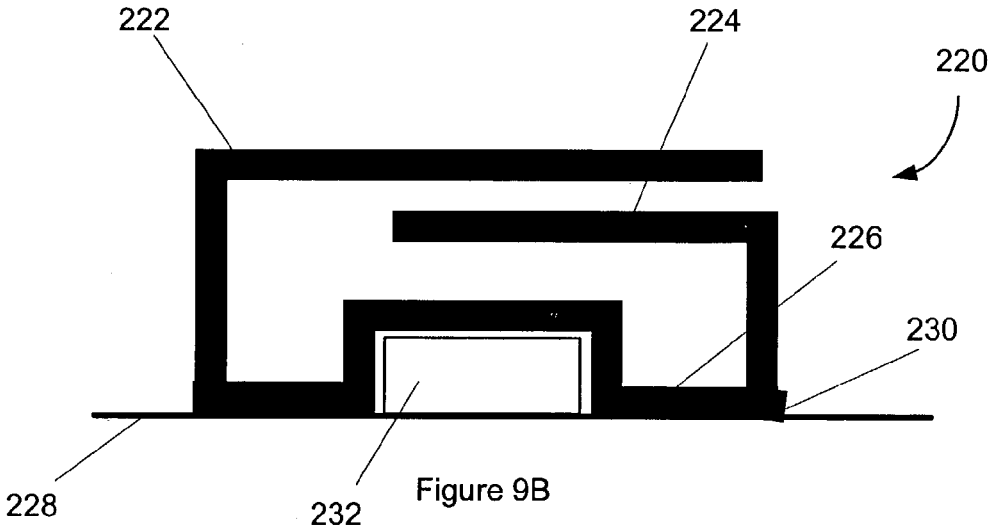
FIG. 9B illustrates a side-view of another embodiment of an antenna element arrangement in accordance with the present invention.

FIG. 9B illustrates an antenna element 220 with a top portion 222, a middle portion 224 and a bottom portion 226. The antenna element 220 is positioned atop a ground plane 228 and is grounded through a ground pad 230. The bottom portion 226 of the antenna element 220 is contoured to accommodate a shield 232 between the ground plane 228 and a portion of the bottom portion 226. In the illustrated embodiment, the bottom portion 226 is provided with a raised central region, allowing the shield 232 to be positioned between the central region of the bottom portion 226 and the ground plane 228.

Figure 9C:
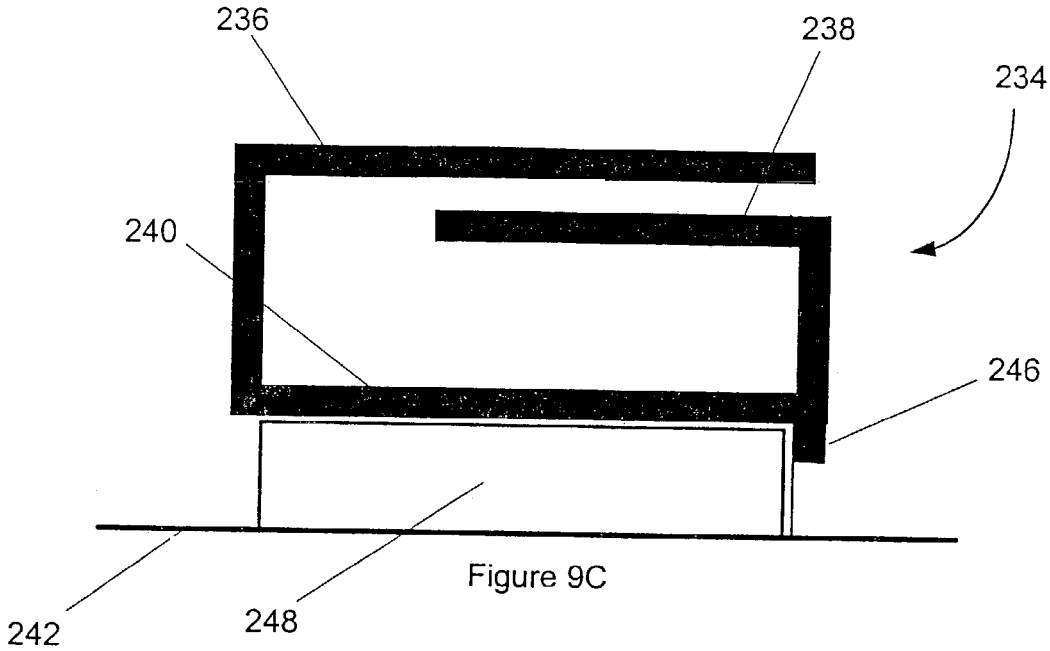
FIG. 9C illustrates a side-view of still another embodiment of an antenna element arrangement in accordance with the present invention.

FIG. 9C illustrates an antenna element 234 with a top portion 236, a middle portion 238 and a bottom portion 240. The antenna element 234 is positioned atop a ground plane 242 and is grounded through an extended ground pad 246. The bottom portion 240 of the antenna element 234 is entirely raised above the ground plane 242. A shield 248 is positioned between the bottom portion 240 and the ground plane 242 to provide improved shielding of the antenna element 234. In the illustrated embodiment, the shield 248 extends substantially the entire length of the bottom portion 240, but does not extend beyond the bottom portion 240.

Figure 9D:
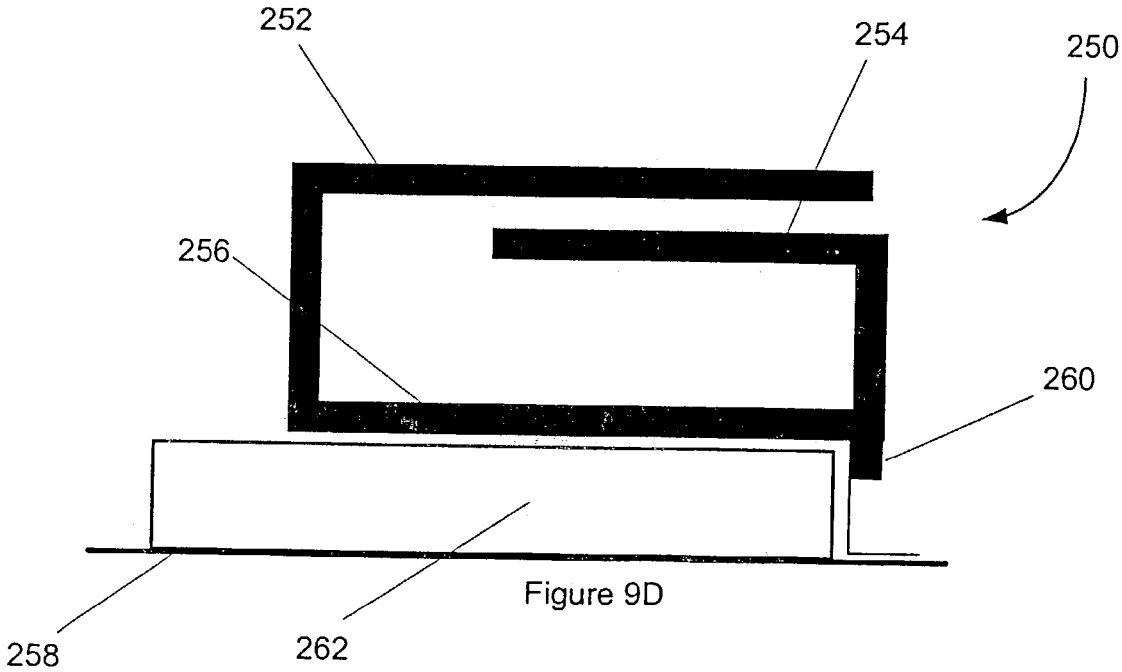
FIG. 9D illustrates a side-view of yet another embodiment of an antenna element arrangement in accordance with the present invention.

FIG. 9D illustrates an antenna element 250 with a top portion 252, a middle portion 254 and a bottom portion 256. The antenna element 250 is positioned atop a ground plane 258 and is grounded through an extended ground pad 260. The bottom portion 256 of the antenna element 250 is entirely raised above the ground plane 258. A shield 262 is positioned between the bottom portion 256 and the ground plane 258 to provide improved shielding of the antenna element 250. In the illustrated embodiment, the shield 248 extends beyond one side of the bottom portion 240 to provide improved isolation of the antenna element 250.

Figure 10:
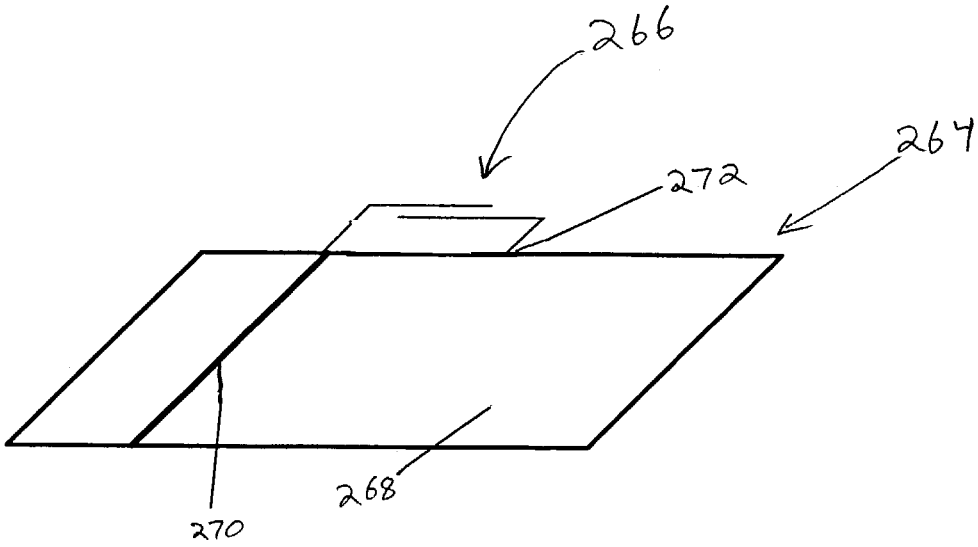
FIG. 10 illustrates a three-dimensional view of an embodiment of an antenna element arrangement in accordance with the present invention.

FIG. 10 illustrates another embodiment of an antenna element arrangement in accordance with the present invention. In the illustrated arrangement 264, a planar CLMD antenna element 266 is positioned in the same plane as a ground plane 268. A line 270, such as a micro-strip line or a coplanar waveguide, for example, is provided to feed power to the antenna element 266. The antenna element 266 is grounded through a ground pad 272 to the ground plane 268. Thus, a very low profile, highly efficient and isolated antenna element arrangement is achieved.

Figure 11A:
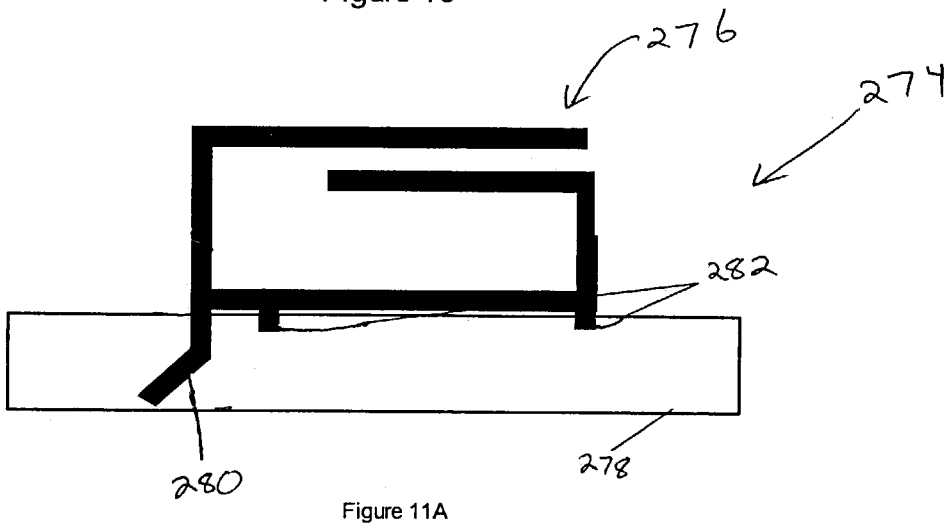
FIG. 11A illustrates a top view of an embodiment of an antenna element arrangement in accordance with the present invention.

FIG. 11A illustrates another embodiment of an antenna element arrangement for achieving a very low profile and improved efficiency and isolation. In the illustrated arrangement 274, a planar CLMD antenna element 276 is positioned in the same plane as a ground plane 278. A line 280, such as a micro-strip line or a coplanar waveguide, for example, is provided to feed power to the antenna element 276. In this embodiment, the antenna element 276 is grounded to the ground plane 268 through a pair of ground pads 282 for improved grounding.

Figure 11B:
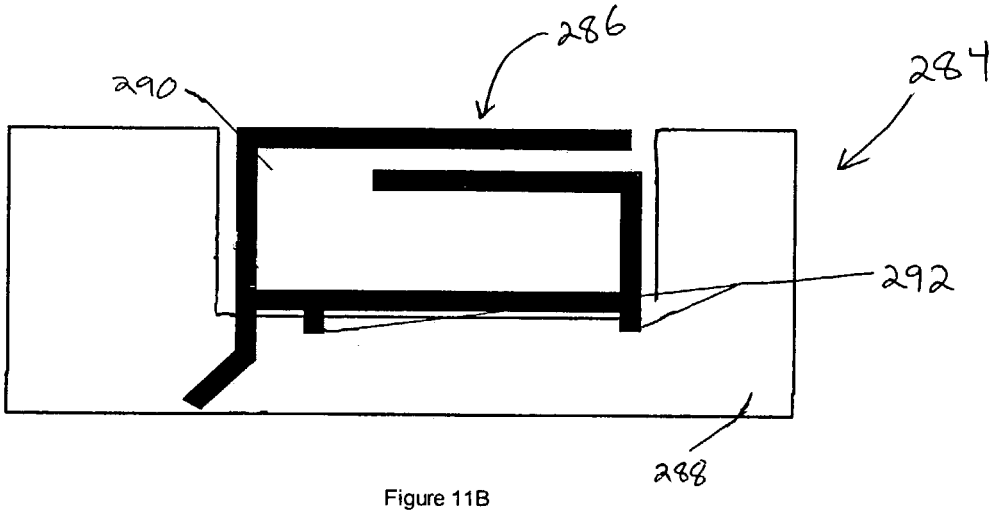
FIG. 11B illustrates a top view of another embodiment of an antenna element arrangement in accordance with the present invention.

FIG. 11B illustrates yet another embodiment of an antenna element arrangement for achieving a very low profile and improved efficiency and isolation. In the illustrated arrangement 284, a planar CLMD antenna element 286 is positioned in the same plane as a ground plane 288. The ground plane 288 is provided with a cutout 290 that is sufficiently large to accommodate the antenna element 286 therein. Thus, the antenna element 286 is surrounded on three sides by the ground plane. Positioning the antenna element 286 in this configuration provides improved isolation. The antenna element 286 is grounded to the ground plane 288 through a pair of ground pads 292.

Figure 12A:
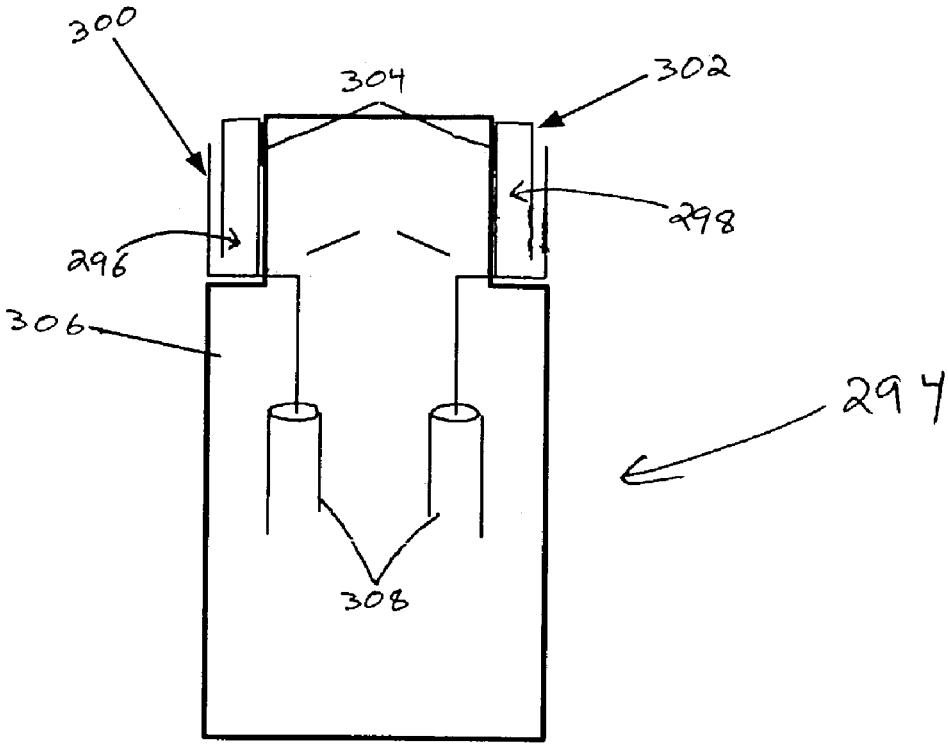
FIG. 12A illustrates a top view of an embodiment of an antenna element arrangement in accordance with the present invention.
Figure 12B:
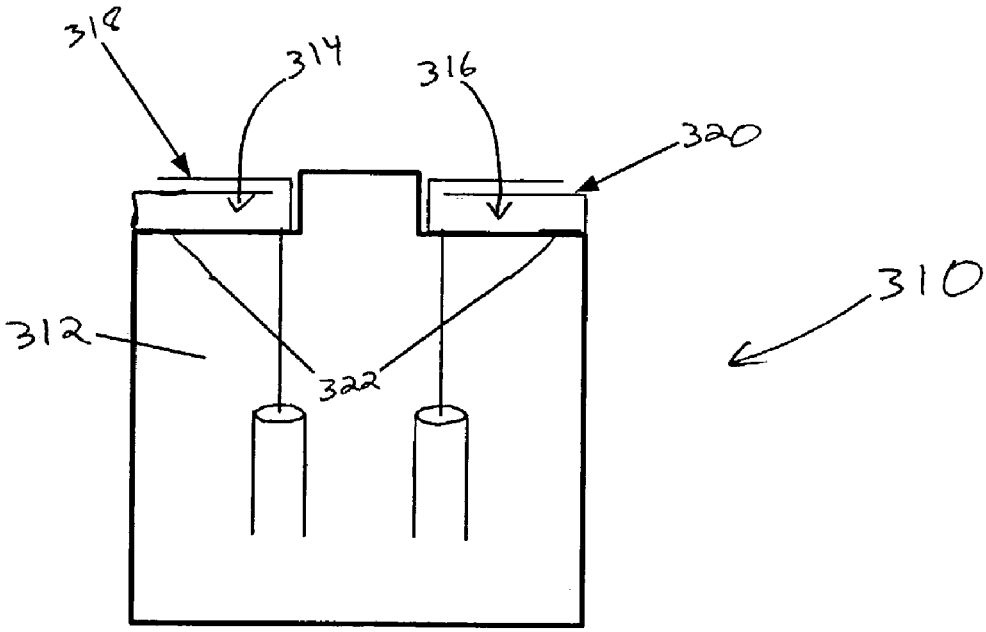
FIG. 12B illustrates a top view of another embodiment of an antenna element arrangement in accordance with the present invention.

FIGS. 12A and 12B illustrate further embodiments of antenna element arrangements in accordance with the present invention. In these embodiments, multiple antenna elements may be provided in a single, low-profile arrangement.

FIG. 12A illustrates an antenna element arrangement 294 having a ground plane 306. The ground plane 306 is provided with a plurality of cutouts 296, 298. In the illustrated embodiment, the ground plane 306 is provided with two cutouts 296, 298 positioned in two corners of the rectangular ground plane 306. In other embodiments, any number of cutouts may be provided, and the cutouts may be positioned at locations other than corners.

The arrangement 294 also includes a plurality of CLMD antenna elements 300, 302. The antenna elements 300, 302 are positioned in a coplanar manner with the ground plane 306 and within the cutouts 296, 298, respectively. This configuration improves the isolation of the antenna elements 300, 302 and results in a low-profile arrangement. Each antenna element 300, 302 is grounded to the ground plane 306 through ground pads 304 and is provided with power through feed lines 308. Thus, the illustrated arrangement 294 results in a low profile and improved isolation. Providing multiple antenna elements, such as antenna elements 300, 302 provides the arrangement with increased diversity.

In the arrangement illustrated in FIG. 12A, the antenna elements 300, 302 are positioned in a mirrored configuration with the bottom portion of each being faced toward the bottom portion of the other.

FIG. 12B illustrates another embodiment of an antenna element arrangement for providing low profile, improved isolation and larger bandwidth. The illustrated arrangement 310 is provided with a ground plane 312 having a plurality of cutouts 314, 316. The arrangement 310 also includes a plurality of CLMD antenna elements 318, 320, positioned in a coplanar manner with the ground plane 312 and within the cutouts 314, 316, respectively. Each antenna element 318, 320 is grounded to the ground plane 312 through ground pads 322. In the arrangement illustrated in FIG. 12B, the antenna elements 318, 320 are positioned in a mirrored configuration about a center axis of the ground plane 312 with a side of each facing a side of the other. In other embodiments, the antenna elements may be positioned in various configurations, including positioning the antenna elements orthogonal to each other or at various angles.

Figure 13:
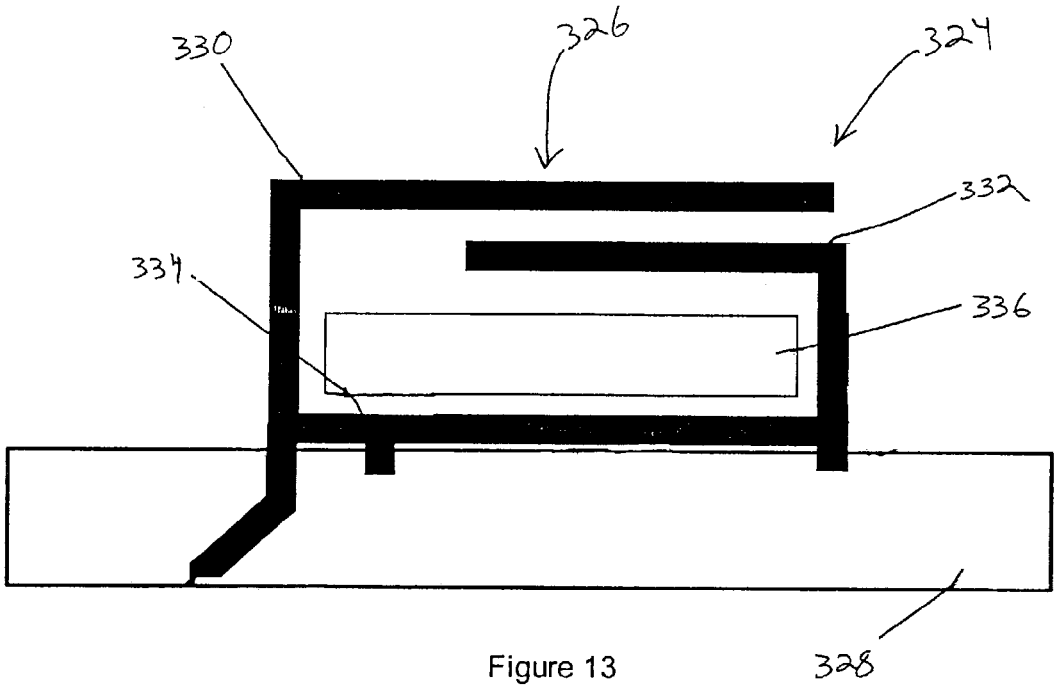
FIG. 13 illustrates a top view of still another embodiment of an antenna element arrangement in accordance with the present invention.

FIG. 13 illustrates another embodiment of an antenna element arrangement in accordance with the present invention. In the illustrated arrangement 324, a CLMD antenna element 326 is positioned in a coplanar manner with a ground plane 328 to provide a low profile. The antenna element 326 includes a top portion 330, a middle portion 332 and a bottom portion 334. A component 336 is positioned in the region between the middle portion 332 and the bottom portion 334. The component may be any component such as electrical components including passive and active components such as capacitors, resistors and chipsets. In other embodiments, the component may be positioned between the top plate 330 and the middle plate 332. In additional embodiments, more than one component may be positioned within the antenna element. In this manner, the footprint of the antenna element may be used to accommodate the components, thereby conserving valuable space in small devices.

While particular embodiments of the present invention have been disclosed, it is to be understood that various different modifications and combinations are possible and are contemplated within the true spirit and scope of the appended claims. There is no intention, therefore, of limitations to the exact abstract or disclosure herein presented.

We claim:

1. An antenna element, comprising:

a ground plane;

a top portion positioned a first distance from the ground plane;

a bottom portion positioned parallel to the top portion and a second distance from the ground plane;

a middle portion positioned parallel to the top portion and the bottom portion and positioned a third distance from the ground plane, the third distance being between the first distance and the second distance placing the middle portion between the top portion and the bottom portion; and at least one ground pad adapted to ground the antenna element to the ground plane, the ground pads being further adapted to contact the ground plane at more than a single point;

wherein the ground plane, bottom portion, middle portion, and top portion are all positioned in different planes, and wherein the first, second and third distances are different from each other.

2. An antenna element comprising:

a top portion;

a bottom portion positioned parallel to the top portion;

a middle portion positioned parallel to the top portion and the bottom portion and positioned between the top portion and the bottom portion; and at least one ground pad adapted to ground the antenna element to a ground plane, the ground pads being further adapted to contact the ground plane at more than a single point, wherein the ground pad is elongated and extends along at least a portion of the bottom portion, and wherein the top, middle and bottom portions are all positioned different distances away from the ground plane.

3. An antenna element comprising:

a top portion;

a bottom portion positioned parallel to the top portion;

a middle portion positioned parallel to the top portion and the bottom portion and positioned between the top portion and the bottom portion; and at least one ground pad adapted to ground the antenna element to a ground plane, the ground pads being further adapted to contact the ground plane at more than a single point, wherein the at least one ground pad includes a plurality of ground pads distributed along at least a portion of the bottom portion, and wherein the top, middle and bottom portions are all positioned different distances away from the ground plane.

4. An antenna element, comprising:

a ground plane;

a top portion positioned a first distance from the ground plane;

a bottom portion positioned parallel to the top portion and a second distance from the ground plane;

a middle portion positioned parallel to the top portion and the bottom portion and positioned a third distance from the ground plane, the third distance being between the first distance and the second distance placing the middle portion between the top portion and the bottom portion; and at least one ground pad adapted to ground the antenna element to the ground plane, the ground pads being further adapted to contact the ground plane at more than a single point;

wherein the bottom portion further comprising ridges forming the ground pads.

5. The antenna element of claim 4, wherein the ridges are V-shaped.

6. The antenna element of claim 4, wherein the ridges are block shaped.

7. The antenna element of claim 4, wherein the ridges are saw-tooth shaped.

8. The antenna element of claim 4, wherein the top portion further comprises ridges.

9. The antenna element of claim 8, wherein the top portion ridges track the bottom portion ridges.

10. The antenna element of claim 4, wherein the middle portion further comprises ridges.

11. The antenna element of claim 10, wherein the middle portion ridges track the bottom portion ridges.

12. The antenna element of claim 4, further comprising at least two deflectors positioned around the antenna element, the deflectors being adapted to deflect an electric field generated by the antenna element.

13. The antenna element of claim 4, further comprising a wave guide in communication with the antenna element and being adapted to direct an electric fields generated by the antenna element.

14. The antenna element of claim 4, further comprising a shield positioned between the ground plane and at least a portion of the bottom portion of the antenna element.

15. The antenna element of claim 14, wherein the ground plane further comprises a lower portion and a raised portion, the bottom portion of the antenna element resting on the lower portion and raised portion of the ground plane, and the shield being positioned between the raised portion of the ground plane and the bottom portion of the antenna element.

16. The antenna element of claim 15, wherein the raised portion of the ground plane is positioned on one end of the bottom portion of the antenna element.

17. The antenna element of claim 15, wherein the raised portion of the ground plane is positioned in a central region of the bottom portion of the antenna element.

18. The antenna element of claim 14, wherein the shield extends beyond the length of the bottom portion of the antenna element and the ground plane.

19. The antenna element of claim 4, wherein the bottom portion of the antenna element is positioned substantially coplanar with the ground plane.

20. The antenna element claim 19, wherein the ground plane further comprises a cutout configured for receiving the bottom portion of the antenna element.

21. The antenna element of claim 19, further comprising a plurality of antenna elements and the ground plane further comprises a plurality of cutouts, each cutout configured for receiving one of the plurality of antenna elements.

22. The antenna element of claim 21, wherein the plurality of cutouts are positioned such that the plurality of antenna elements are arranged in a mirrored configuration to each other.

23. The antenna element of claim 21, wherein the plurality of cutouts are positioned such that the plurality of antenna elements are arranged in an orthogonal configuration to each other.

24. The antenna element of claim 4, further comprising at least one component positioned in a gap between either the top portion and the middle portion, the top portion and the bottom portion, or the middle portion and the bottom portion.

25. The antenna element of claim 24, wherein the component is an electrical component.

* * * * *